United States Patent [19]

Klygis et al.

[11] 3,946,862

[45] Mar. 30, 1976

[54] CONTAINER PACKAGE

[75] Inventors: Mindaugas Julius Klygis, Evergreen Park; Ronald C. Owen, Harwood Heights, both of Ill.

[73] Assignee: Illinois Tool Works Inc., Chicago, Ill.

[22] Filed: July 16, 1974

[21] Appl. No.: 488,983

[52] U.S. Cl. ..... 206/150; 206/427; 294/87.2

[51] Int. Cl.[2] ..... B65D 75/28

[58] Field of Search ..... 206/150, 151, 152, 153, 206/154, 427, 428, ; 294/87.2; 224/45 A, 45 AA

[56] References Cited

UNITED STATES PATENTS

| | | | |
|---|---|---|---|
| 2,896,779 | 7/1959 | Armel | 294/87.2 X |
| 3,044,230 | 7/1962 | Fisher | 294/87.2 X |
| 3,084,792 | 4/1963 | Poupitch | 206/498 X |
| 3,097,740 | 7/1963 | Poupitch | 206/150 X |
| 3,330,408 | 7/1967 | Wanderer | 206/150 |
| 3,627,123 | 12/1971 | Wachter | 206/150 |
| 3,711,145 | 1/1973 | Rapata | 294/87.2 |
| 3,721,337 | 3/1973 | Braun et al. | 206/150 |
| 3,727,754 | 4/1973 | Cunningham | 206/150 |
| 3,784,003 | 1/1974 | Bolton | 206/158 |

*Primary Examiner*—William T. Dixson, Jr.
*Assistant Examiner*—Stephen P. Garbe
*Attorney, Agent, or Firm*—Olson, Trexler, Wolters, Bushnell & Fosse, Ltd.

[57] ABSTRACT

There is disclosed a package comprising a plurality of containers such as bottles, a plastic sheet material carrier member individually encircling and gripping top portions of each container and a complementary sheet material carrier member having interconnected portions, each of which encircles and grips at least two of the containers adjacent lower ends thereof.

2 Claims, 7 Drawing Figures

CONTAINER PACKAGE

The present invention relates to a novel container package, and more particularly to novel plastic sheet material carrier means for such a package.

In U.S. Pat. No. 3,721,337, there is disclosed a package which utilizes a plastic sheet material carrier having individual pockets for receiving and engaging upper ends of bottles and a lower or supplementary carrier member having individual pockets separately encircling and gripping lower end portions of the bottles for enhancing stability of the bottles in the package. The present invention is concerned with an improved package utilizing such an upper carrier member and a novel lower or supplementary carrier member.

More specifically, it is an important object of the present invention to provide a novel multiple container package and carrier structure therefor including an upper carrier member engagable with individual containers and a lower or supplementary carrier member which is constructed so as to facilitate assembly thereof with multiple containers in the package whereby to simplify the assembly method and/or the machinery required to accomplish assembly.

A further object of the present invention is to provide a novel supplementary carrier member for a multiple container package of the above-described type wherein the supplementary carrier member may be easily and economically formed from sheet material such as plastic and is of substantially scrapless construction.

A further object of the present invention is to provide a novel multiple container package and carrier structure therefor of the above described type which include the supplementary carrier member for retaining lower end portions of containers in the package in a manner which facilitates removal of a container from the package after the container has been disengaged from the upper or primary carrier member.

A further and more specific object of the present invention is to provide a novel container package such as a six-pack or eight-pack of bottles and the like and including an upper or primary carrier member preferably formed from a sheet of tough resilient plastic material including pockets or individual aperture means respectively for embracing and securely retaining upper end portions of the bottles and a lower or supplementary carrier member also formed of a tough resilient plastic sheet material which is slit in a substantially scrapless manner to provide interconnected portions, each of which is adapted to encircle and tightly embrace at least two of the containers whereby to simplify not only the structure of the secondary carrier member but also to simplify both application of the secondary carrier member to the containers and subsequent removal of the containers from the package.

Other objects and advantages of the present invention will become apparent from the following description and the accompanying drawings.

DESCRIPTION OF THE PREFERRED EMBODIMENTS

Figure 1:
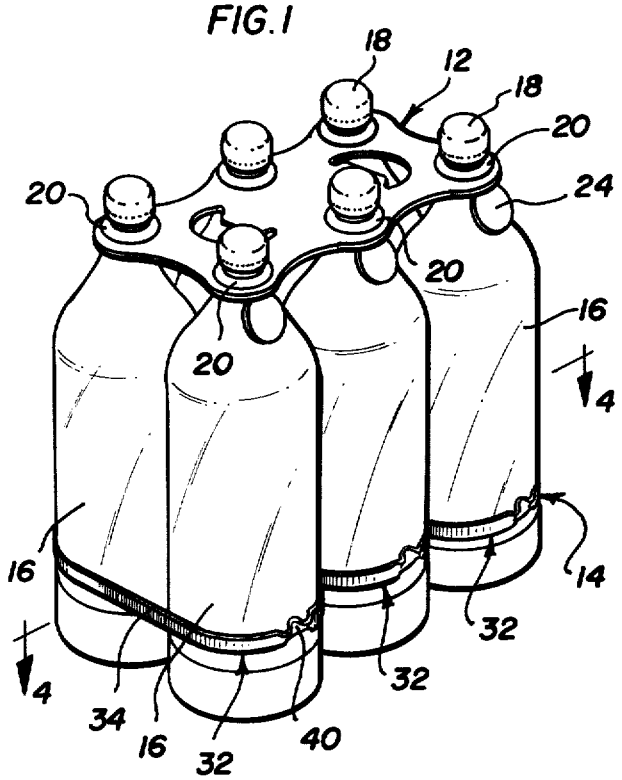
FIG. 1 is a perspective view showing a multiple container package incorporating features of the present invention.
Figure 2:
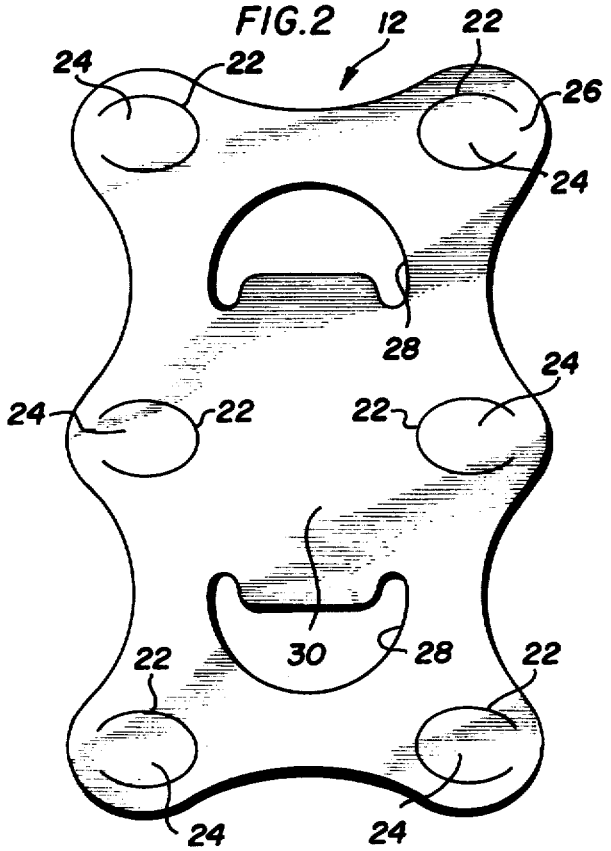
FIG. 2 is a plan view showing an upper or primary carrier member which may be incorporated in a package constructed in accordance with the present invention.

Referring now more specifically to the drawings wherein like parts are designated by the same numerals throughout the various figures, a package 10 incorporating features of the present invention is shown in FIG. 1. The package comprises an upper or primary carrier member 12 formed from a tough resilient plastic sheet material and a lower or supplementary carrier member 14 also formed of a tough resilient plastic sheet material. In the embodiment shown, the package includes six containers 16 in the form of bottles having reduced diameter neck portions including annular shoulders or enlargements 20 and closed by caps 18. The dimensions of the carrier members and the containers or bottles are correlated so that, in the finished package, the bottles are retained and resiliently drawn by the carrier members substantially against each other so as to provide a compact and relatively rigid and self-supporting package.

In the embodiment shown herein, the upper or primary carrier member 12 is identical to the corresponding carrier member disclosed in the aforementioned U.S. Pat. No. 3,721,337. Therefore, the disclosure need not be repeated in great detail. It suffices to state that the carrier member 12 is formed from a sheet of tough resilient deformable or stretchable plastic material such as polyethylene and is provided with a plurality of individual apertures or pocket means 22. These apertures or pocket means are provided by slitting the sheet material so as to form knockouts or tabs 24 which remain connected to the sheet at 26. The apertures or pocket means 22 are arranged in a predetermined pattern so as to be in alignment with and to receive upper end portions of the containers in the package. The carrier member 12 is assembled with the containers by inserting the upper end portions of the containers to the pocket means so that the annular enlargements 20 are snapped through the apertures. The dimensions of the pocket means or apertures are such that the material of the plastic sheet must be slightly stretched to accomplish this assembly whereupon the pocket means retracts for securely retaining the bottles.

As shown in FIG. 1, prior to assembly of the carrier member 12 with the containers, the tabs 24 are deflected downwardly so as to avoid interfering with the bottle necks. These tabs provide pull means for enabling a user to tear the container for removal of the bottles as described more in detail in the above-mentioned prior patent. The carrier member 12 also includes finger openings 28 so that the central portion 30 of the carrier member comprises handle means by which a user may carry the package.

Figure 4:
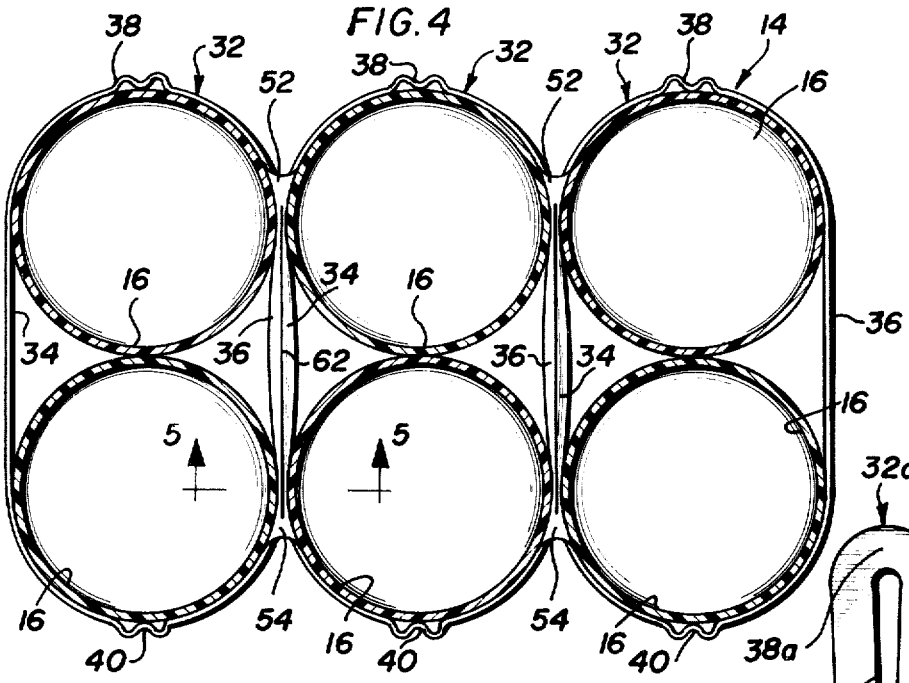
FIG. 4 is a cross-sectional view taken generally along the line 4—4 in FIG. 1 and particularly showing the manner in which the lower or supplementary carrier member of FIG. 3 is manipulated for bracing containers in the package.

In the embodiment shown, the container package includes six bottles arranged in groups of twos with the bottles in each group being in side-by-side abutting relationship as shown best in FIG. 4. Furthermore, the bottles of one group are disposed in substantially abutting relationship with the bottles of an adjacent group and are separated only slightly adjacent lower ends thereof by portions of the carrier member 14 as will be described more in detail below.

It is to be understood, that the present invention contemplates a container package having any desired plurality of groups of containers. In other words, while the embodiment shown includes three groups of two containers, the package with appropriate modifications of the carrier members could be constructed so as to include more than three groups of containers and even only two groups of containers. Furthermore, while each group of containers in the embodiment shown comprises two containers, it is contemplated that the supplementary carrier member may be modified so as to accommodate groups comprising three or more containers. In any event, the containers in each group will be disposed in abutting relationship with each other and in substantially abutting relationship with the containers of an adjacent group.

Figure 3:
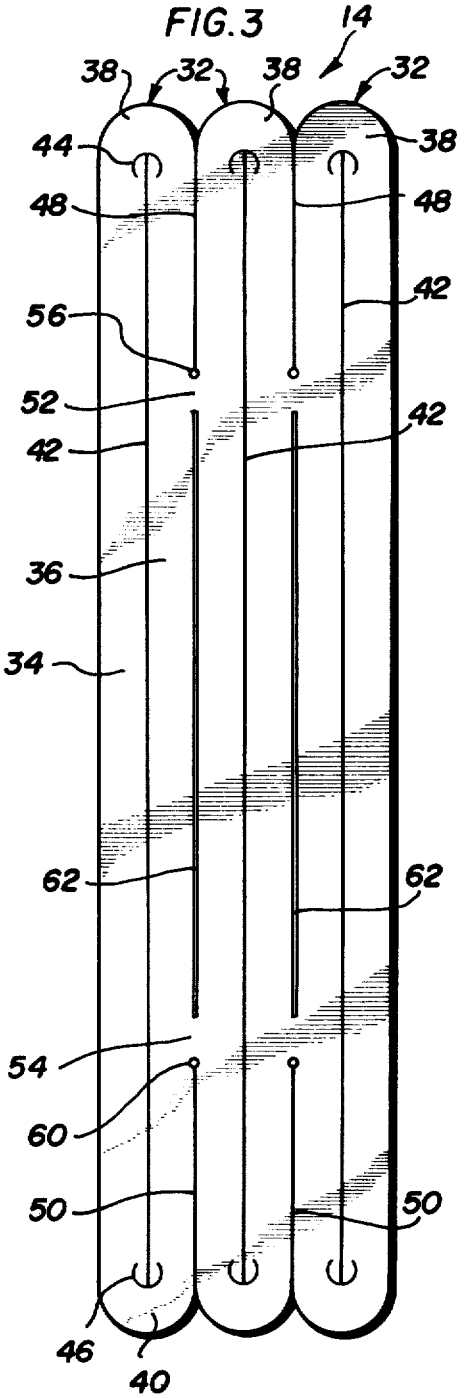
FIG. 3 is a plan view of a lower or supplementary carrier member incorporating features of the present invention in its normal condition prior to being assembled with containers in a package.

As shown in FIG. 3, the carrier member 14 is initially formed from a flat sheet of tough resilient and deformable plastic material such as polyethylene. In the embodiment shown, the carrier member 14 is provided with a plurality of interconnected band portions 32 each having opposite side sections 34 and 36 joined at opposite ends by connecting sections 38 and 40. In order to form the band portions, the sheet material is provided with parallel slits 42 which extend substantially entirely across the sheet and terminate at the connecting sections 38 and 40. Preferably, opposite ends of the slits are defined by small punched apertures or as in the embodiment shown by semi-circular slits 44 and 46 so as to prevent tearing of the connecting sections 38 and 40 when the carrier is applied to the bottles as described below.

In addition to the slits 42, the sheet material is formed with opposite side slits 48 and 50 between each band portions. These slits extend inwardly from margins of the sheet material to uninterrupted connecting areas 52 and 54 between adjacent band portions. Inner ends of the slits 48 and 50 are defined by small punched apertures 56 and 60 so as to resist tearing of the material during assembly with the containers. Preferably the sheet material is scored or coined along lines 62 between the uninterrupted connecting areas 52 and 54 so as to provide readily bendable junctions between adjacent band portions. In the embodiment shown, the outer ends of the connecting sections 38 and 40 are slightly rounded and this can be accomplished by providing the sheet stock material with scalloped edges. In any event, it will be apparent that the carrier member 14 is slit and scored so that there will be little or no scrap material.

The supplementary carrier member 14 is assembled with the container package by manipulating the flat blank so as to open and slightly stretch each of the band portions so that each band portion is adapted to receive all of the containers in one of the groups of containers. In other words, in the embodiments shown, each of the band portions extends around and resiliently grips and retains two containers.

As shown in FIG. 4, the side sections 34 and 36 of each band portion 32 are related to the dimensions of the containers so that the containers in each group are snugly drawn against each other. In addition, the slits 48 and 50 between adjacent band portions extend so that the uninterrupted junction areas 52 and 54 are located somewhat inwardly of the container package and preferably substantially at the points of substantial abutment between the containers of adjacent groups.

Figure 5:
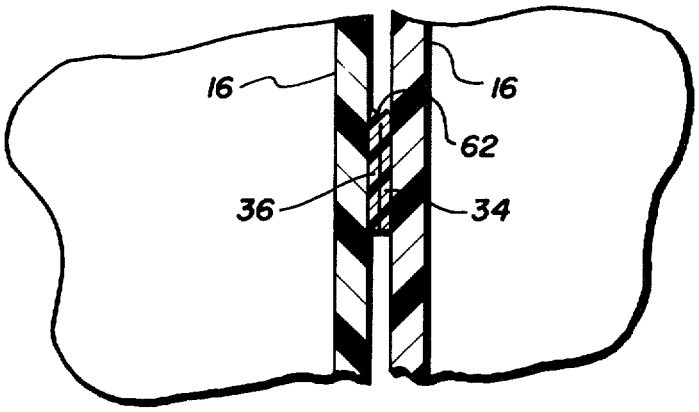
FIG. 5 is an enlarged fragmentary sectional view taken generally along line 5—5 in FIG. 4.
Figure 6:
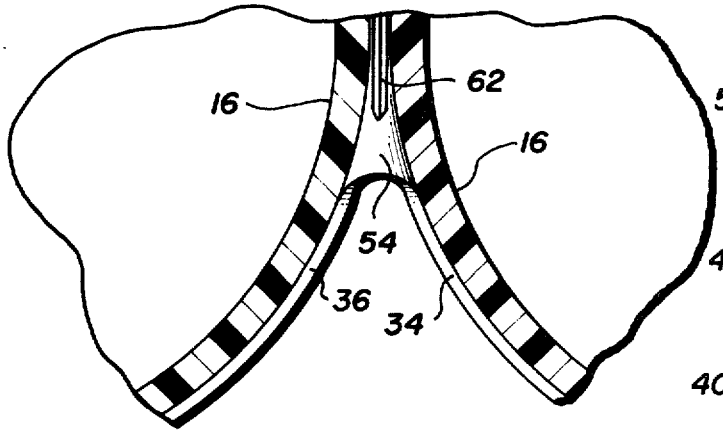
FIG. 6 is an enlarged fragmentary view of a portion of FIG. 4 showing the structure in greater detail.

As shown in FIG. 4 and in greater detail in FIGS. 5 and 6, when the carrier 14 is assembled with the containers, adjacent sections 34 and 36 of adjacent band portions are folded together so that the containers of adjacent groups are slightly spaced from each other only by the double thickness of the thin sheet plastic material and the uninterrupted junctions or connecting areas 52 and 54 are between the adjacent containers of adjacent groups so as to insure that these containers will be held together as tightly as possible without increasing the space therebetween.

In the container package including the novel supplementary carrier member 14, it is seen that the individual containers are tightly drawn by the resilient plastic band portions into abutting relationship with adjacent containers in their own groups and are additionally securely held in substantially abutting relationship with the containers in the adjacent groups whereby the package is relatively rigid and self-supporting. Such an arrangement facilitates both handling and stacking or storing of the package.

It is further seen that since each band portion of the carrier 14 encircles a plurality of containers, assembly of the carrier member in the package is greatly facilitated and machinery requirements for such assembly are simplified. Furthermore, removal of the containers from the package by a user is facilitated. In this connection, it is seen that the primary or upper carrier member 20 which snugly embraces the upper ends of each of the containers has the tear tabs 24 for facilitating rupturing or the aperture or pocket means 22 and removal of a container. When the upper end of a container is freed from the carrier, the lower end may be relatively easily slipped axially upwardly since the band portion of the lower container only engages the container for approximately 50 percent of the container circumference.

Figure 7:
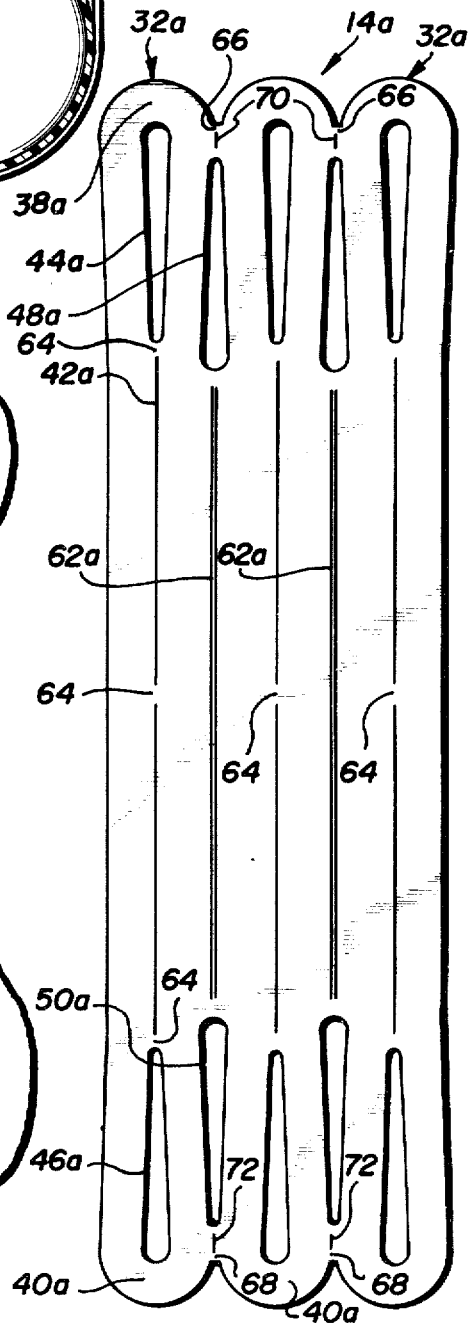
FIG. 7 is a plan view similar to FIG. 3 showing a blank for a lower or supplementary carrier member incorporating a modified form of the present invention.

FIG. 7 shows a lower or supplementary carrier member **14*a* embodying a modified form of the present invention. It is to be understood that the carrier member 14*a* may be substituted in the container package described above for the carrier member 14**. In this embodiment, elements which correspond to those described above are indicated by the application of the same reference numerals with the suffix *a* added and therefore need not be described in detail. In this embodiment, opposite end portions of the slits **42*a* are formed with elongated narrow and inwardly tapered slots 44*a* and 46*a* rather than the generally semi-circular slits described above. In addition, the slits between adjacent band portions have been replaced by elongated narrow slots 48*a* and 50*a* tapered oppositely from the slots 44*a* and 46*a***. This arrangement facilitates forming of the band portions around the containers without creating undue amounts of scrap material.

In the embodiment of FIG. 7, it is also important to note that the slits **42*a* are interrupted by narrow tear sections 64 at midportions thereof. Additional narrow tear sections 66 and 68 interrupted by slits 70 and 72 are provided between opposite ends of adjacent band portions and more specifically at outer ends of the slots 48***a* and 50*a*. During assembly of the carrier member 14*a* with the containers, the tear sections 64, 66 and 68 are easily ruptured so that the carrier member is applied to the containers in substantially the same manner as the carrier member 14 described above. However, these tear sections make the sheet material from which the carrier member is formed more stable or self-supporting so as to facilitate handling of the carrier member. In this connection, it is to be understood that the carrier member 14*a* as well as the carrier member 14 described above may be readily manufactured from a long continuous strip of sheet material stock. Furthermore, a plurality of the carrier members may be retained together in a strip of stock material from which they may be cut during or shortly before assmbly with the containers. Similarly, the upper or primary carrier member 12 is adapted to be formed from a strip of sheet material and to be cut from the strip of stock material during or shortly before assembly with the containers.

While preferred embodiments of the present invention have been shown and described herein, it is obvious that many details may be changed without departing from the spirit and scope of the appended claims.

The invention is claimed as follows:

1. A supplementary carrier member for a container package of the type described comprising a plurality of containers arranged in groups of at least two containers with the containers in each group being in abutting relationship with each other and in substantially abutting relationship with containers in adjacent groups, said carrier member comprising a sheet material member having a plurality of parallel slits extending between and terminating short of opposite margins of the member and defining a band portion having opposite side sections and opposite end connecting sections, said member including uninterrupted connecting areas joining adjacent band portions at locations substantially inwardly from opposite margins of the member, slit means extending from adjacent said opposite margins substantially to said uninterrupted areas for separating adjacent band portions from each other, and each of said band portions having a circumferential extent for encircling all of the containers in one of said group of containers, said sheet material member including rupturable connecting elements between the opposite side sections of each of said band portions and interrupting said slits and additional rupturable connecting elements between adjacent band portions adjacent opposite margins of said member for facilitating handling of said member prior to assembly with the containers, said rupturable connecting portions being rupturable for permitting manipulation of the band portions for assembly with the containers.

2. A supplementary carrier member for a container package of the type described comprising a plurality of containers arranged in groups of at least two containers with the containers in each group being in abutting relationship with each other and in substantially abutting relationship with containers in adjacent groups, said carrier member comprising a sheet material member comprising a series of interconnected bands, each of said bands comprising opposite side sections and opposite end connecting sections, the longitudinally central portion of said opposite side sections of each of said bands being joined by a plurality of rupturable connecting portions whereby rupturing of said rupturable connecting portions enables each of said bands to be circumferentially applied about one group of said containers, the opposite end connecting sections and the portions of said opposite side sections from said longitudinally central portion to said opposite end connecting sections being formed to define apertures tapering from said end connecting sections to said longitudinally central portion, and each of said bands being interconnected to adjacent ones of said bands at the outer marginal edges of the junctions of said end connecting sections to said side sections.

* * * * *